US008964992B2

(12) United States Patent
Bruney

(10) Patent No.: US 8,964,992 B2
(45) Date of Patent: Feb. 24, 2015

(54) PSYCHOACOUSTIC INTERFACE

(76) Inventor: Paul Bruney, Silver Spring, MD (US)

( * ) Notice: Subject to any disclaimer, the term of this patent is extended or adjusted under 35 U.S.C. 154(b) by 327 days.

(21) Appl. No.: 13/538,345

(22) Filed: Jun. 29, 2012

(65) Prior Publication Data

US 2013/0077792 A1 Mar. 28, 2013

Related U.S. Application Data

(60) Provisional application No. 61/539,036, filed on Sep. 26, 2011.

(51) Int. Cl.
*H04R 5/00* (2006.01)

(52) U.S. Cl.
CPC ..... *H04R 5/00* (2013.01)
USPC ..... 381/17

(58) Field of Classification Search
CPC ..... H04S 2420/01; H04S 7/30; H04S 5/00; H04S 3/002; H04S 7/303
USPC ..... 381/17
See application file for complete search history.

(56) References Cited

U.S. PATENT DOCUMENTS

| | | | |
|---|---|---|---|
| 4,204,092 | A | 5/1980 | Bruney |
| 4,218,585 | A | 8/1980 | Carver |
| 4,495,637 | A | 1/1985 | Bruney |
| 4,567,607 | A | 1/1986 | Bruney |
| 4,817,149 | A | 3/1989 | Myers |
| 6,928,168 | B2 | 8/2005 | Kirkeby |
| 7,242,782 | B1 | 7/2007 | Kasai et al. |
| 7,711,127 | B2 | 5/2010 | Suzuki et al. |
| 7,787,638 | B2 | 8/2010 | Lokki et al. |

*Primary Examiner* — Alexander Jamal
(74) *Attorney, Agent, or Firm* — Laubscher, Spendlove & Laubscher, P.C.

(57) ABSTRACT

An audio imaging method and cognition interface for two-loudspeaker playback is intended for use with standard stereo recordings. The process applies new azimuth-based equalization and phase measurements specifically derived for stereo playback while faithfully interfacing with and eliciting human psychoacoustic localization responses via the Fletcher-Munson loudness effect. The process accurately recovers and reproduces three-dimensional sonic image locations inherently encoded in standard recordings so that a listener may accurately perceive the three-dimensional sound. Sound images are reproduced in at least the forward 180° free-field environment of the listener. The apparatus is designed to allow reproduction of atypical recordings made with closely-spaced microphones if desired.

20 Claims, 8 Drawing Sheets

PSYCHOACOUSTIC INTERFACE

This application claims the benefit of U.S. provisional patent application No. 61/539,036 filed Sep. 26, 2011.

BACKGROUND OF THE INVENTION

The angular disposition of a sound source from a position directly in front of a listener to a position to the side of a listener is accompanied by audible amplitude increases in frequencies greater than ~300 Hz at the near side (outer ear contributions), reduced amplitudes at the far side (because of the head shadow), and relative phase differences and arrival times to each ear. Such cues are used by the brain to locate angular or azimuth sound source positions relative to the listener. Additional cues created by outer ear geometry allow vertical sounds to be located.

Stereophonic playback inherently creates such cues for two loudspeaker locations as the sound sources that are correspondingly processed by the listener's brain. These cues psychoacoustically define an essentially flat two-dimensional soundstage that spans the area between the speakers.

The present invention relates to a new method and apparatus for accurately interfacing three-dimensional spatial cues inherently embedded in audio sources with a listener's cognitive psychoacoustic responses when the sources are played back through two loudspeakers.

BRIEF DESCRIPTION OF THE PRIOR ART

Numerous attempts have been made to diminish spatial playback shortcomings. Typical examples are signal processors that subjectively widen the apparent image of the reproduced sound stage using phase shifts and/or equalization as disclosed for example in the Bruney U.S. Pat. Nos. 4,495,637 and 4,567,607 and Kirkeby U.S. Pat. No. 6,928,168. Also known are designs which apply equalization, phase shift, or time delays as disclosed in the Carver U.S. Pat. No. 4,218,585, the Myers U.S. Pat. No. 4,817,149, and the Suzuki U.S. Pat. No. 7,711,127 or processes that create "surround-sound" effects using multiple loudspeakers or phase-shifting effects. Other examples include multiple-speaker recording and/or playback techniques as disclosed for example in the Lokki et al U.S. Pat. No. 7,787,638. Attempts have been made to address various problems that arise from multi-speaker geometries, such as phase shifts to avoid intracranial sense as disclosed in the Kasai et al U.S. Pat. No. 7,242,782. All of these prior efforts create various forms of image distortions. These designs fail to recognize that dimensional cues are inherently preserved in audio feeds as a function of the location of a sound source relative to a microphone, fail to take into account the consequences of attempting to reproduce the spatial location of a real single sound source with two loudspeakers resulting from a misapplication of existing head related transfer functions, and fail to understand human cognition responses, i.e., how sound is interpreted by the mind.

The first successful attempt at dimensionally accurate image fidelity was described in the Bruney U.S. Pat. No. 4,204,092 which incorporated an additional factor crucial to spatial localization. Here, the role of the well-known Fletcher-Munson (F-M) effect to both distance and angular perception via the shape of the outer ears and head was first hypothesized. The passive circuit interface described in the patent incorporated four loudspeakers in a coordinate system centered on a listener. It presented sounds to the listener's ears that tracked relative channel balance analogous to the outer ear and head shadow effects that occur in natural free-field hearing. This allowed inherently encoded angle and distance information between sound sources and microphones to be accurately perceived in the forward 180° free-field environment of a listener, with the listener virtually occupying the position of the recording microphones. However, the Bruney '092 patent did not appreciate that relative phase differences between the ears arose intrinsically for the side-positioned speakers in the configuration. Nor were the phase differences anticipated or the explicit frequency changes addressed in the two-speaker versions described in the same patent.

The only other notable three dimension design is a recent one that is optimized for the playback of binaural recordings; i.e., recordings made with a binaural mannequin head. Such recordings already contain outer ear and head shadow modifications and are traditionally intended for headphone playback. This two-speaker playback process utilizes an elaborate set of filters to cancel the inherent acoustic location cues of the two loudspeaker positions and operates at frequencies primarily below 6 kHz. It requires a calibration procedure that measures the acoustical traits of the playback environment in conjunction with the listener's outer ears and head shadow or, less optimally, a binaural mannequin head in the listening position. Listener location (the so-called "sweet spot") is critical, as the system requires minimizing the head shadow effect. The loudspeakers are optimally placed closely together with the subtended angle between the speakers and the listener about 10°. Greater speaker separation reduces image quality. It is best suited to physically small loudspeakers to minimize image shifts caused by small head movements. Playback of mixed-microphone recordings using this method does not address the consequences of reproduced sound sources located at different angles relative to a listener and does not attempt to provide additional head and outer ear modifications.

SUMMARY OF THE INVENTION

The present invention is based on a greater understanding of how humans hear. It represents a comprehensive application of cognitive neuroscience that spans both recording and playback processes by directly addressing how sound is interpreted by the brain. The resultant interface establishes a direct link between stimuli or location cues in sound sources and the corresponding cognitive hearing responses.

It is a primary object of the present invention, using only two speakers, to allow a listener to accurately perceive distance information inherently encoded within standard audio recordings as a function of the distance between recorded sound sources and the recording microphones, or the distance information as modified by recording and/or mixing techniques. Another object of the invention is to accurately recover and reproduce angular information within recordings as a function of stereo channel balance by using newly derived hearing measurements made with two correlated sound sources. These hearing measurements produce curves referred to as stereo transfer functions or STFs. Additional consequences are the ability to discern vertical image locations preserved in standard recordings, a broadened listening position including not only the optimal position but also regions to either side where spatial cues can be perceived, and significantly improved sonic clarity and detail presently conjectured as related to the precision of reproduced locations. These objects are accomplished without highly-restrictive limitations on loudspeaker size, type, or location by directly linking dimensional cues embedded in audio program sources to the psychoacoustic responses of a human listener via a precision audio cognition interface. Interface applications include, but are not limited to, music reproduction, movie soundtracks, television sound, 3-D movies, 3-D video games, and 3-D television, wherein apparent moving sound sources in three-dimensional space are faithfully synchronized with and track their corresponding three-dimensional moving visual images.

A primary problem addressed by the invention concerns the non-linear nature of human cognitive hearing responses as it pertains to stereo image fidelity. The focus of this nonlinearity is the above-mentioned Fletcher-Munson effect. This "loudness" trait demonstrates that the perception of sounds does not strictly correspond to reality. The Fletcher-Munson measurements show that the same tonal balance is perceived differently at different volume levels, and over the changing volume range there is little or no linear correspondence of what is subjectively heard relative to the frequency balance actually present. The more sophisticated ability to discern sound locations in three-dimensional space directly involves the Fletcher-Munson effect, so the listener's ability to localize sounds reproduced through two stereo loudspeakers is likewise subject to associated nonlinearities with unanticipated consequences.

For this reason, the playback method and apparatus of the present invention employ a new approach: unique equalization and phase curves derived from new free-field hearing measurements. The measurement method was developed solely for the purpose of faithful angular (azimuth) image reproduction relative to a listener using two loudspeakers.

The resulting curves represent a notable departure from the prior art. There have been numerous attempts in stereo playback to make spatial imaging more natural. Some past efforts incorporate conventional measurements of sound locations relative to the human head. These measurements are derived using a single sound source of fixed volume level placed in various equidistant positions around a human subject. The measurements denote the location of the real sound source and yield well-known head-related transfer functions or HRTFs. However, employing HRTF curves in stereo playback fails by varying degrees to accurately restore apparent image locations. The difference is that the locations are played back by one or both off-center sound sources (the two loudspeakers) placed in fixed positions forward of the listener's head rather than a real single sound source positioned at some angle relative to the listener's head. One would naively expect that these speaker-related location changes relative to the listener could be correspondingly corrected using the existing HRTF curves. However, the perceived location changes are additionally aberrated by the nonlinear Fletcher-Munson process involved in sound localization. This thwarts the ability to straightforwardly calculate the HRTFs for the stereo format and instead results in unanticipated and largely unpredictable differences in the perception of reproduced sound locations.

By contrast, the azimuth curves of the subject invention avoid the HRTF failings altogether by directly measuring what two stereo loudspeakers must do to accurately reproduce the apparent sound positions. These new and distinctly different curves are the aforementioned stereo transfer functions (STFs). They are derived from measurements of two stationary real sound sources and denote various locations of a single imaginary or virtual sound source as determined by the listener. These curves uniquely redefine outer ear/head shadow corrections for two-speaker playback and reveal critical areas of error when misapplying standard HRTF curves.

In the present invention, these STF curves are applied such that relative channel balance in normal stereo sound sources is equated to the forward 180° free-field space centered on the listener. A second test method, analogous to the first, employs these unique curves to provide accurate distance perception using two loudspeakers.

Consequently, the new STF parameters are combined with the knowledge of the link between spatial localization and the Fletcher-Munson, or loudness, effect and can be incorporated within active circuitry or software for stereo playback applications. The resulting audio process utilizes only two speakers and allows the listener to accurately localize distance, angular, and vertical image locations inherently preserved in standard recordings. Adjustments for equalization and phase accommodate a range of different speaker/listener geometries, loudspeaker types, and variations in recordings.

Although primarily intended for imaging in the forward 180° free field of a listener using regular, mixed multi-microphone recordings, some sound locations recorded slightly behind the listener can be accurately reproduced. Further, an optional modified method and apparatus is designed to accommodate non-standard recordings made either with a binaural head or with a pair of closely spaced microphones. The success of this option depends heavily on the performance of filters used in the phase-related portions of the apparatus execution.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
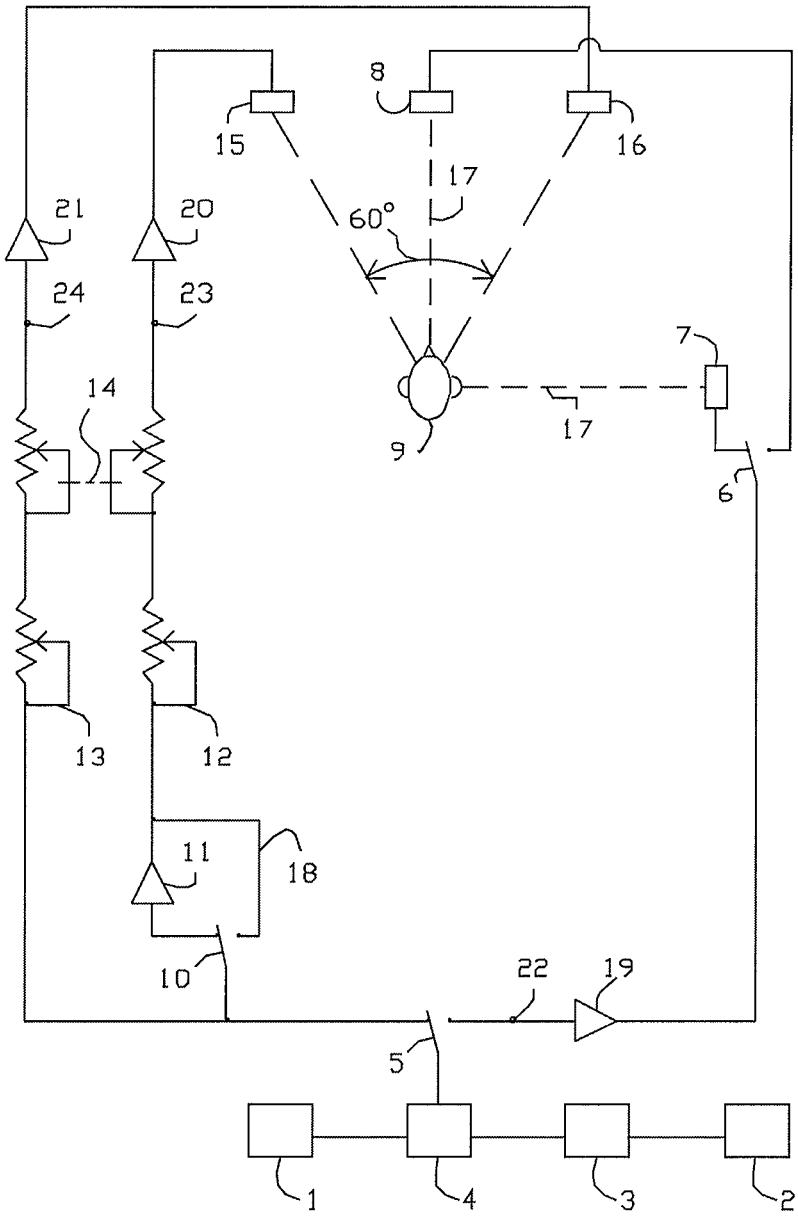
FIG. 1 is a circuit diagram of the testing format of the free-field two-speaker azimuth according to the invention.

In FIG. 1, there is shown a layout of the new free-field test system utilized to determine listener responses to stereo playback in accordance with the inventive method. In these tests, a range of audio signals are played back through a pair of stereo speakers configured in traditional stereo geometry wherein the listener and the speakers form an equilateral triangle. In the tests, a group of subjects is asked to compare the stereo signals directly to corresponding sounds from a single reference loudspeaker located either directly in front of the listener at 0° or to one side at 90°, such that the location of the sound from the reference speaker and the apparent location of the sound from the stereo speaker or speakers is indistinguishable. All of the subject's results are averaged for the final set of curves. The resultant stereo curves or stereo transfer functions (STFs)—which are in the form of azimuth equalization curves—recreate sound image angles equivalent to those of a single real loudspeaker located either directly in front of a listener at 0° or to one side at 90°.

More particularly, FIG. 1 shows a layout of the free-field tests conducted outdoors in an open field, wherein the 0° and 90° reference speakers are shown, respectively, in front of and to the right of the subject. All amplifiers in the test are identical with equal gains. All speakers in the test are identical and positioned at ear height.

The test apparatus includes a sine wave generator 1 and pink noise generator 2 as the signal sources with a bandpass filter 3 in series with the pink noise generator. The signal generator and center of the bandpass filter are always tuned to the same frequency. The pure tone and filtered noise are mixed together or selected separately at a mixer 4. The mixer output is delivered to a stereo/reference selector switch 5. From switch 5, the signal is switched either to reference selector switch 6 or to the rest of the stereo speaker input circuits. The reference selector switch 6 selects between the side reference speaker 7 or the center reference speaker 8 via power amplifier 19. The distances 17 between the reference speakers and the listening subject 9 are equal.

If the selector switch 5 is in the stereo pair position, the signal passes to phase switch 10 which selects between a phase inverter 11 or a bypass line 18. Both go to the left channel volume control 12. The signal also goes directly into the right channel volume control 13. Both signals then pass through the dual overall volume control 14. The respective output signals then pass through respective left and right amplifiers 20 and 21 and to left and right speakers 15 and 16, respectively. Signal amplitudes are measured at reference speaker test point 22 and respective left and right speaker test points 23 and 24.

Test subjects make adjustments so that the individual sounds reproduced by the stereo speaker pair were indistinguishable in loudness and angle from the reference source when switched. The subjects compare the reproduced sound source directly with the real reference sound source by using the selector switch, 5. Multiple tests were conducted at test frequencies ranging from 20 Hz-15 kHz. For some frequency bands, both a pure tone and bandwidth-limited noise (using a narrow bandpass filter centered on the same frequency) needed to be mixed together as an aid to localization. Only the pure tone amplitudes were then compared and measured.

The following is a summary of the test method steps:

(A) Select frequency (B) Select front or side reference speaker (1) Listen to the reference speaker (2) Listen to speaker pair for level and angular location (3) Adjust speaker pair levels (4) Compare apparent level and angular location to reference speaker (5) Repeat steps 1-4 until no difference is heard in level and angular location (6) Record speaker pair levels for that frequency (C) Select next frequency (D) Repeat steps 1-6

(E) Repeat all steps for other reference speaker positions.

Figure 2A:
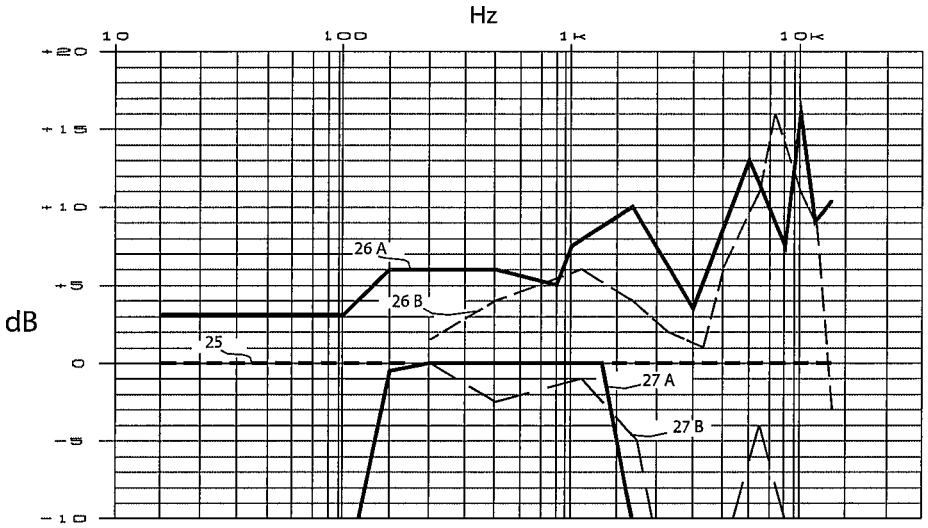
FIG. 2A is a graphical representation of the resultant azimuth equalization and phase plots (STF curves) from the tests of FIG. 1 and typical HRTF curves for the same 90° image location.

In FIG. 2A, the averaged curves for both channels are shown. The dashed plot 25 represents a centrally placed monaural signal from speaker 8, plot 26A represents the near signal from speaker 16, and plot 27A represents the far signal from speaker 15. The signals corresponding to the latter plots 26A and 27A, when heard together, are the psychoacoustic equivalent of the 90° side-positioned sound source of speaker 7. Plots 26A and 27A together constitute the stereo transfer functions for 90°. The frequencies between 200 Hz-1.5 kHz that are reproduced by speaker 15 represented by plot 27A are fixed at 180° out-of-phase with the corresponding frequencies reproduced by speaker 16 represented by plot 26A. The out-of-phase condition was chosen for its simplicity and ease of incorporation into the tests.

For reproducing the monaural tones only, which correspond to the position of speaker 8 at 0°, the frequency response of left and right stereo channels remains flat, but their individual levels are reduced by −3 dB each. The result is that the two loudspeakers 15 and 16 sum their outputs acoustically by +3 dB. This −3 dB level is shown as the 0 dB reference level in the curves of FIG. 2A with the left and right channel levels actually expressed relative to 0 dB. Note that this same total −3 dB monaural reduction is incorporated within studio stereo recordings where Orban-type pan potentiometers are used for placing signals relative to left or right channels (i.e., −3 dB in both channels for centrally-located sounds).

Relative amplitudes for intermediate angles are not shown, but can be derived by the same measurement process.

Plot 26A in FIG. 2A can be characterized as possessing specific regions: a flat response for all frequencies <100 Hz; a transition region in the 100-200 Hz range; another essentially flat response between 200-500 Hz; a very slight transition downward between 500-800 Hz; another upward transition between 800 Hz-1 kHz; an increasing slope from 1 kHz to ~2.3 kHz; a downward transition from ~2.3 kHz to a minimum at 4 kHz; and a generally increasing range above 4 kHz with peaks at ~6 kHz, a maximum at ~10 kHz, a lower peak at ~15 kHz, and intervening dips at ~8 kHz and ~12 kHz.

The unexpected imaging deviations created by stereo playback are first seen by comparing the common regions of line 26A with the corresponding HRTF curves such as disclosed in Sivian, L., et al, *On Minimum Audible Sound Fields*, J. Acoust. Soc. Amer., 4, 1933, p. 288-321. The HRTF curves for the near and opposite ears for a sound source located at 90° to one side of a listener are shown by respective long-dashed plots 26B and 27B in FIG. 2A.

In plot 26A, the flat region between 200-500 Hz is +6 dB above the 0° (monaural) level. By contrast, the HRTF plot 26 B notably differs; at 300 Hz it is +1.5 dB and at 500 Hz it is +4 dB. At 1 kHz, plot 26A is +7.5 dB, whereas HRTF plot 26B has a peak at 1.1 kHz of only +6 dB. At 2.2 kHz, plot 26A has a peak at +10 dB, whereas the HRTF curve 26B falls considerably in the opposite direction at +4 dB. At 3.2 kHz, plot 26A is +6.5 dB, whereas HRTF plot 26B is still very low at only +2 dB.

It should be noted that the latter two large deviations occur in the most sensitive or audible frequency range of human hearing. At 4.2 kHz, plot 26A is +3 dB and HRTF plot 26B is +1.5 dB. At 5 kHz, plot 26A is +9.5 dB and HRTF plot 26B is +7 dB. At 6.6 kHz, plot 26A is +13 dB and the HRTF plot is +11 dB. At 7.6 kHz, plot 26A dips down to +7.5, but the HRTF plot 26B peaks at +16 dB. At 10 kHz, plot 26A peaks at +16 dB, but the HRTF plot 26 B drops to +11 dB. At these two latter points, the frequencies of the troughs and strong peaks have exchanged positions between 7.6 kHz and 10 kHz. These frequencies are in the region of the spectrum associated with the perception of vertical elevation. At 12 kHz, plot 26A and HRTF plot 26B are both +9 dB. At 15 kHz, plot 26A rises to about +10.5 dB, whereas HRTF plot 26B is −3 dB.

The more pronounced comparison discrepancies cited in the frequency bands above coincide with the same frequency regions of the Fletcher-Munson curves that exhibit increased nonlinear loudness responses.

The deviations of plot 27A from the HRTF curves are also revealing. At 300 Hz, both plot 27A and the HRTF plot 27B are equal at 0 dB. At 500 Hz, plot 27A remains at 0 dB, whereas the HRTF plot 27B drops to −3 dB. At 1 kHz, plot 27A remains at 0 dB and the HRTF plot 27B is −1 dB. At 1.5 kHz, plot 27A remains at 0 dB, then drops dramatically above that. There is no HRTF value for 1.5 kHz but an interpolated value would be −2.5 dB. At 2.2 kHz, plot 27A is −10 dB, whereas the HRTF plot is only −4.5 dB.

It was noted in measuring the STF curves that any output in plot 27A immediately above 1.5 kHz reduces the angular location of the side image, so the steepness of the slope just above 1.5 kHz is critical.

Test subjects further reported that the out-of-phase signal, plot 27A, was absolutely necessary throughout the 200 Hz-1.5 kHz range in order to place images 90° to the side of the listener. This STF range and phase result departs significantly from previous conventional single-sound-source hearing data, which indicates that phase sensitivity diminishes above the 700-800 Hz maximum-sensitivity range (wavelengths~19.3"-16.8") and becomes essentially non-existent at approximately 1.4-1.5 kHz.

It is, however, understandable that such out-of-phase information at 1.4-1.5 kHz could still be processed by the hearing localization system when stimulated by the two-speaker playback geometry in the tests. The 700-800 Hz region is associated with the width of the head. Since an average ear-to-ear distance is ~6.5", this suggests that the out-of phase ½-wavelength in this maximum phase-sensitivity range, or about 9.65-8.4", corresponds to the lengths of acoustic paths around the head to the opposite ear. For example, a 1.5 kHz sine wave (the averaged resultant frequency of the azimuth tests) has a wavelength of 9", which is approximately half a 750 Hz wavelength (the average frequency of maximum phase sensitivity). A sine wave at this frequency, emanating from a single 90° sound source, is attenuated by the head but not totally blocked from the far ear. As such, an out-of-phase condition can exist at opposite ears for two consecutive 1.5 kHz wavelengths. Human localization ability may thereby still naturally possess a reduced sensitivity to this frequency range when strongly excited by two distinctly separate but correlated sound sources.

Figure 2B:
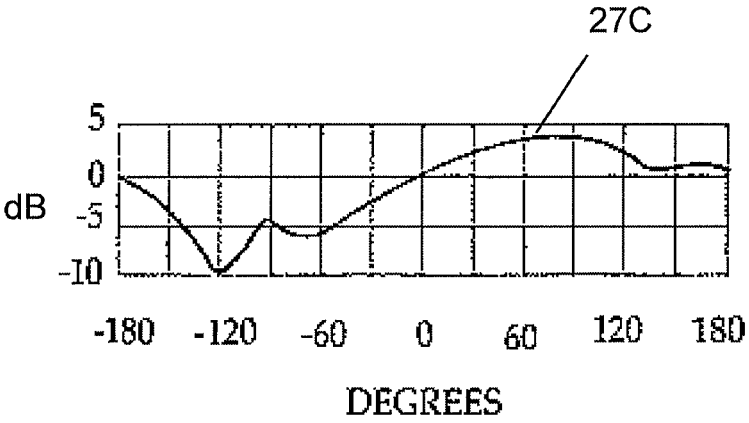
FIG. 2B is a graphical representation of an HRTF curve for a ±180° range of single sound source locations at 2.2 kHz.

It is also easily shown that the HRTFs for loudspeakers at a given location cannot be simply calculated to produce the above STF curves. For example, consider attempting to reproduce an apparent 90° sound position from a speaker located at 30°. According to the HRTF curve 27C for 2.2 kHz (FIG. 2B), a speaker positioned at 30° has an amplitude contribution of +2.5 dB relative to 0 . That frequency would only need a +1.5 dB boost to be equivalent to the HRTF value of +4 dB to create an apparent 90° sound location, whereas the measured STF value for an apparent 90° location is actually +10 dB. The computed HRTF correction has an error of −6 dB. This error would place the sound only slightly beyond the actual loudspeaker location rather than out to the extreme side of the listener.

More generally, the cognitive STF shapes, frequency peaks, troughs, amplitudes, and phases in critical portions of the spectrum differ in non-obvious and significant ways from their conventional HRTF counterparts.

It should be emphasized that neither distance perception nor vertical perception was evaluated in the above azimuth tests which instead focused exclusively on relative amplitudes and angles of single tones alone, not the subjective judgments of distances or elevations of groups of frequencies taken as single signals in the near field.

In near field hearing, overall volume level decreases as a sound source moves away from a listener or a microphone. Low frequency amplitudes decrease more rapidly with increasing distance relative to midrange content because of low-frequency omnidirectional dispersion, while higher frequencies, which tend to be directional or beaming, are attenuated with increasing distance by dissipative losses in the air medium. Only low frequencies persist at great distances.

A connection exists between these acoustic properties and the evolved frequency bias of the Fletcher-Munson loudness effect, where higher volume levels appear to have more high- and low-frequency content relative to midrange frequencies than sounds at lower volume levels. Distance assessments of complex sounds and angles, such as occur in everyday hearing, intrinsically entail the relationship between the geometry of the head and ears and the Fletcher-Munson effect. The effect compliments the shape and size of the head and outer ears and is thus directly implicated in angular, vertical, and distance localization. Distance perception is in turn dependent on the degree of intracranial sense, which in its pure form, such as with headphones, creates the illusion that the sound is completely inside a listener's head. In free-field hearing, as the proportion of this sense is increased, the relative distance of a sound source is perceived as coming closer to the listener.

Figure 3:
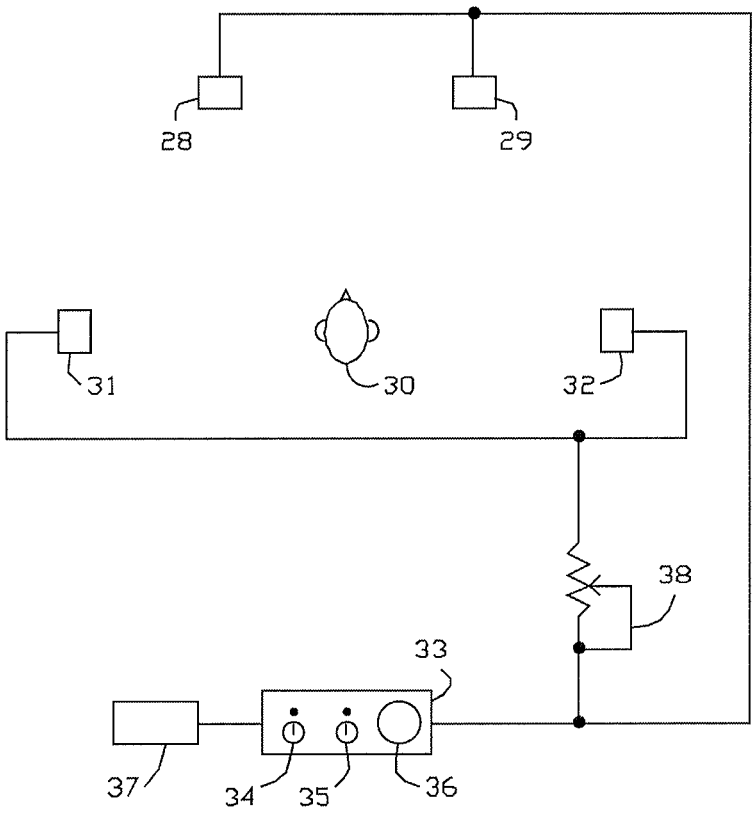
FIG. 3 is a diagram illustrating a Fletcher-Munson/localization demonstration test.

As a clear illustration of this interrelationship, consider the 4-speaker geometry in FIG. 3, with all speakers placed equidistant to the listener. Left and right loudspeakers 28 and 29, respectively, are positioned forward of the listener 30 and loudspeakers 31 and 32 are located to the listener's respective left and right sides. The speakers are driven with a single channel of a preamplifier/amplifier 33 equipped with bass and treble tone controls, 34 and 35, respectively, and a single main output volume control 36. The preamplifier/amplifier uses a pink noise generator 37 as its sound source.

With tone controls in the flat position without any boosts or cuts, the monaural pink noise source is fed through the preamplifier/amplifier 33 to both front speakers equally, such that the noise appears centered between the two front speakers. The same sound is fed equally to both side speakers at a reduced but still audible volume with an in-line volume control 38. This moves the apparent center sound somewhat closer to the listener. In this format, the side speakers provide sounds analogous to those reflected down the ear canals by the outer ears during free-field hearing of an actual centrally-placed sound source. This is an active angle-dependent outer ear function that remains static during stereo (two-speaker) playback. Side-speaker volume control 38 determines a ratio that remains fixed. Any changes in the main volume or tone control settings via control 36 and controls 34 and 35 occur together by the same ratio in all speakers.

If either the bass or treble or both tone controls are turned up, the sound will be heard to advance toward the listener. If either or both are turned down, the sound will appear to recede away from the listener. If the listener repeats these steps with one ear plugged, the sound will appear to move angularly either towards or away from the side of the open ear, respectively. The change in tonal balance defines an angular clue to the listener. If, instead of manipulating the tone controls, the main output volume control 36 is either increased or decreased, the same distance and angular results will be observed because of the subjective change in tonal balance created by the listener's Fletcher-Munson effect. This also illustrates that the side speaker sounds, analogous to the reflected outer ear contributions, operate in concert with the Fletcher-Munson effect to vary the proportion of intracranial sense, and thereby distance perception, when heard with both ears. For this reason, a variable Fletcher-Munson loudness control, well-known in the art, can be used instead of tone controls as an adjustment for apparent image distances when the proper outer ear contributions are present.

Additional tests were conducted using recordings of a pink noise sound source played through a loudspeaker at known distances from a single microphone. Recordings were played back at the same volume level using the playback format of FIG. 3 and the two stereo playback loudspeakers in the geometry as shown in FIG. 1 using the newly-derived azimuth playback equalization curves. Analogous to the above test method, relative distance was subjectively judged by comparing the recorded and played-back distances to an actual reference sound source such as a loudspeaker located at those same distances from the listener. A pan control sweeping the image from left to right verifies that the space between two stereo loudspeaker locations requires a progressively increasing augmentation of these outer ear cues for intracranial sense to restore distance perception for increasingly monauralized or centrally-placed images. That is, the redefined azimuth equalizations including frequencies above 1.5 kHz need to be increasingly emphasized for centrally located images, the degree of increase depending on the loudspeaker angle relative to the listener. This new finding for reproduced distance perception using two sound sources also generally matches prior single-sound-source angular hearing measurements that concluded directional azimuth cues are based only on intensity differences heard between the ears for frequencies above 1.5 kHz. This further corroborates the connection between distance perception and angular perception abilities.

It follows from this interrelationship and from the traits of sound propagation through air that the relative distance between a sound source and a microphone is inherently encoded in recordings as a function of the distance-related volume level and frequency content, or those sounds as modified by recording or mixing techniques. This distance information can be decoded by a listener's cognitive localization abilities provided its playback is properly interfaced to the listener's ears.

With such an interface, accurate vertical location decoding is also possible if (a) an actual recorded sound source is well above the ground surface where bass frequencies are more rapidly attenuated by the absence of a nearby reinforcing ground surface to limit omnidirectional dispersion, or (b) if a sound is equivalently recorded or mixed with higher relative amplitudes in and above the 7-8 kHz range. This frequency range is within a non-linear region of the Fletcher-Munson effect that at highest loudness levels becomes centered at ~10 kHz, and is in this same region as the outer ear contributions made for vertically-displaced sound sources. Thus, the vertical cognition result likewise conforms to the relationship between the Fletcher-Munson effect, outer ear frequency alteration, and psychoacoustic localization ability. It also corroborates the correction in this high-frequency region seen in the STF curves as noted above.

From the above description, (a) the two-speaker format creates azimuth-related STFs that differ significantly from single sound source (HRTF) measurements in order to recreate correct angular image positions, and (b) the Fletcher-Munson effect plays an integral localization role in concert with these changes. When a single sound source is placed center-stage the sound common to both ears includes contributions from the outer ears that are reflected directly down the ear canals. These cues are dependent on the actual distance of the sound source to the listener or, in the case of a recording, on the actual distance between the sound source and the microphone or as those cues are modified by recording techniques.

Proper interfacing with the listener thus entails dynamic psychoacoustic corrections to the stationary location "signatures" of the two loudspeakers. In addition to perceptually amending the erroneous loudspeaker position cues, it necessitates appropriately engaging the listener's Fletcher-Munson/localization responses. This allows 3-D sound source position cues preserved in recordings to be correctly perceived.

Figure 4A:
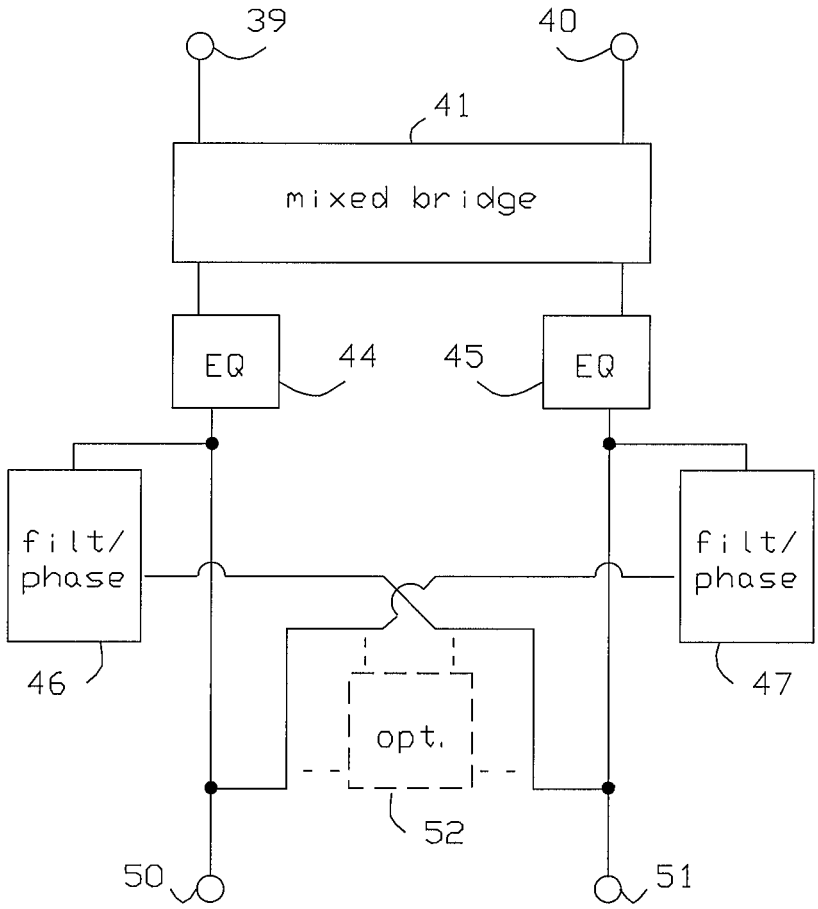
FIG. 4A is a block diagram illustrating the interrelationships among the three essential elements and an optional fourth element of the auditory cognition method of the present invention.

The manner in which these interrelated aspects of cognition are simultaneously addressed for two-loudspeaker playback are schematically represented in the block diagram of FIG. 4A wherein left and right signal inputs are represented by terminals 39 and 40 and outputs by terminals 50 and 51. The method incorporates three essential elements that operate in tandem dynamically. The resultant cognitive responses of the listener are dependent upon localization information intrinsically embedded within the audio signal sources as follows:

(1) channel balance-dependent phase-bandpass processes, represented by blocks 46 and 47, together can accommodate phase and amplitude discrimination with a changing angle corresponding to channel balance relative to a human listener;

(2) a channel-mixing process dependent on channel balance, represented by block 41, accommodates amplitude discrimination and cross-talk with changing angle relative to a human listener; and (3) equalization, represented by blocks 44 and 45, initially corrects head and outer ear anatomically related azimuth discrimination of loudspeaker locations.

During playback, the summed combination of steps dynamically alters the resultant phase, amplitude, and equalization of the outputs in real time according to the stereo source content, thereby simultaneously accommodating the Fletcher-Munson-related localization abilities of a human listener.

A non-dynamic adjustment for bass level is provided for resultant tonal balance to compensate for the loudspeaker location-related equalization setting.

In addition, the method can be modified to accommodate binaural recordings, as described below, by reducing interchannel crosstalk and outer ear equalization while still providing requisite equalized loudspeaker location compensation. This option requires an additional method step:

(4) Optional channel balance-dependent subtractive signals that minimize monaural signal content, represented by block 52.

Figure 4B:
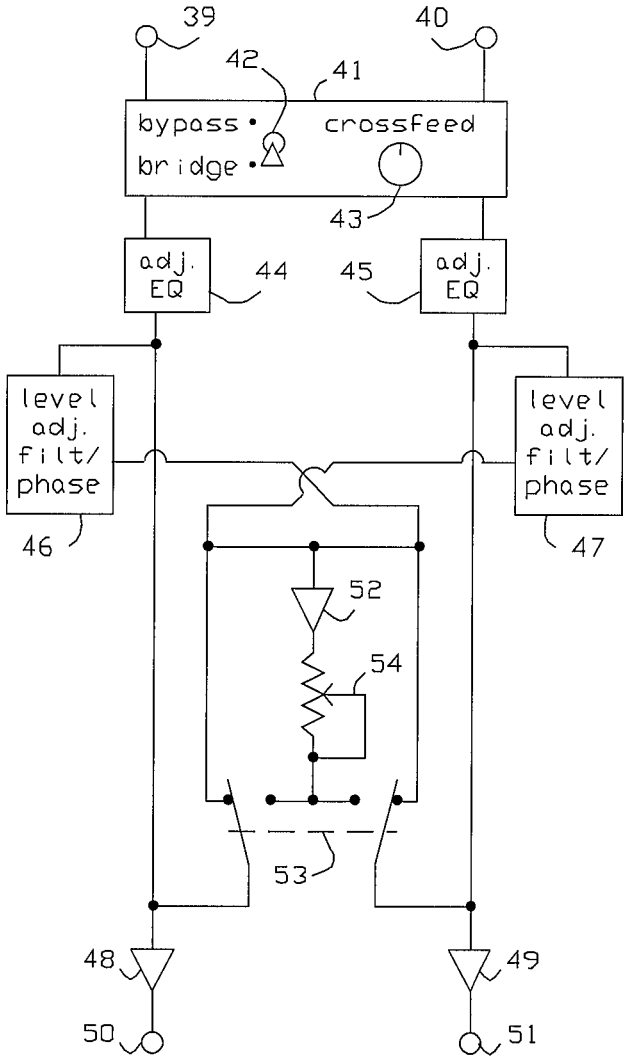
FIG. 4B is a schematic block diagram of the apparatus of the present invention.

FIG. 4B illustrates the circuitry corresponding to the components shown in the block diagram of FIG. 4A. Left and right signal inputs 39 and 40, respectively, pass to an adjustable mixed bridge 41 that tracks channel balance. In FIG. 4B, this bridge is characterized as being equipped with a bridge/bypass selector switch 42 and a control 43 to vary the degree of cross-feed. This function may be implemented either actively or passively in hardware or in software by those skilled in the art. This stage of the process alters the incoming stereo signals prior to being input to left and right adjustable equalization stages 44 and 45, respectively.

The two simultaneous mixed bridge functions are: (a) to provide proper distance perception of centrally-located images by reducing amplitudes of single channel signals relative to monaural signals (i.e., intracranial sense is increased for monaural signals), and (b) to compensate for excessive separations in mixed multi-microphone recordings which do not exist in normal free-field hearing circumstances by providing these separated stereo signals with the required cross-feed for intracranial sense and distance perception of side-located images.

The relative attenuation between single-channel and monaural inputs and the amplitudes of cross-feed mixing are dependent upon signal imbalance between both channels. For monaural signals, there is no cross-feed because both channel signals are identical. Maximum attenuation of the dominant channel and cross-feed to the opposite channel occurs when a signal is present in only the dominant channel.

Figure 5A:
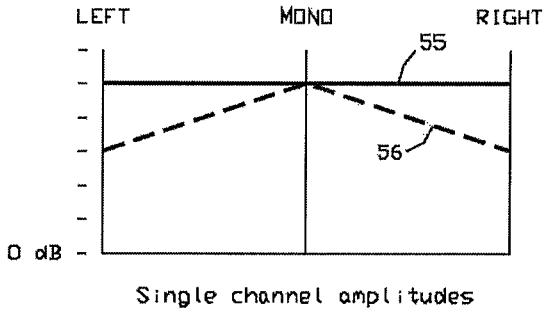
FIG. 5A is a graphical representation of the mixed bridge attenuation function for individual stereo channels relative to channel balance according to the invention.

A representation of the mixed bridge attenuation function, showing both channels relative to channel balance appears in FIG. 5A wherein an example of left-only, monaural-only, and right-only audio input levels is shown by solid line 55. The corresponding mixed bridge left-only, monaural-only, and right-only output levels for the single channels are shown by dashed line 56. No cross-feed effects on opposite channels are represented or included in this figure.

Figure 5B:
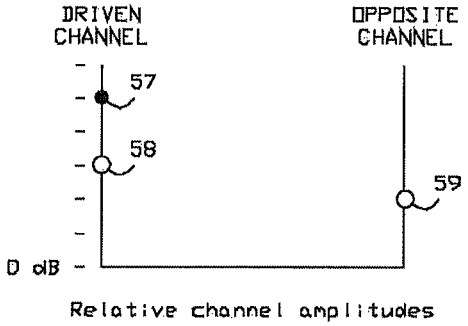
FIG. 5B is a graphical representation of the mixed bridge cross-feed function for a single channel input.

FIG. 5B shows a representation of the mixed bridge cross-feed function between both channels. An unmixed single channel input level is shown by solid circle 57 with zero output on the opposite channel. Corresponding mixed bridge output levels are indicated on the single attenuated and opposite cross-fed channel sides, respectively represented by circles 58 and 59.

Figure 5C:
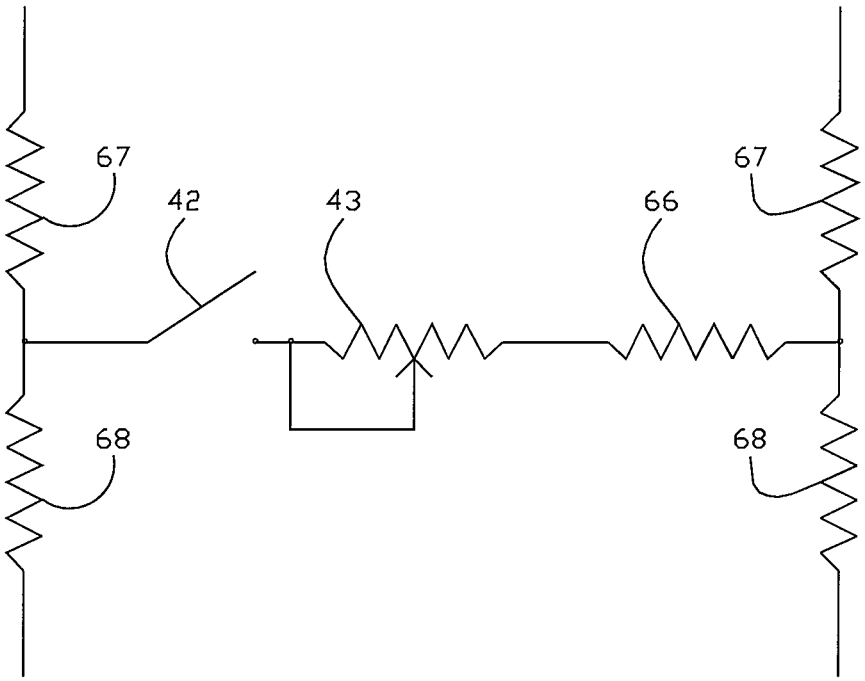
FIG. 5C is a schematic diagram of a mixed bridge resistive network.

An example of the implementation of the mixed bridge providing these functions is shown schematically in FIG. 5C. The bridge/bypass selector switch 42 and cross-feed control 43 are in series with a limit resistor 66. These are connected between resistors 67 and 68 in one channel and like resistors 69 and 70 in the opposite channel.

The diagram in FIG. 4B also incorporates left and right channel phase-shifted or phase-inverted cross-fed bandpass filters 46 and 47 the types of which are known to those skilled in the art. These filters have adjustable output levels as shown in FIG. 4B. By combining these crisscrossed, filtered, and phased signals with the mixed-bridged and equalized stereo signals as shown at the left and right channel summing stages 48 and 49, respectively, amplitudes in left and right channel outputs 50 and 51, respectively, vary according to channel balance within the 200 Hz-1.5 kHz frequency band while simultaneously satisfying the requisite azimuth curves. Output signals in this frequency band that are more monauralized are attenuated or cancelled relative to single-channel-only signals by the added out-of-phase cross-feed filter amplitudes.

An analog hardware implementation of the bandpass filters or its software equivalent requires a two-pole high-pass element and at least a six-pole or greater low-pass element. For analog filters, the degree of phase shift through the bandpass region will vary with frequency such that a trade-off between pass band frequencies and phase shifts are necessary. Alternatively, a digital "brick wall" finite impulse response (FIR) filter or its software equivalent can be used. This type of filter exhibits a constant phase within the bandpass region (for example, 180° out-of-phase with the corresponding equalized region) with an extremely steep low-pass roll-off.

Adjusted amplitudes for these phased cross-feed signals can vary considerably. Amplitudes depend on the angle subtended by the location of the loudspeakers relative to a listener and on recording characteristics such as channel separation, multi-microphone mixing and/or microphone separations. For either, reduced separation requires increased phased cross-feed.

The optional binaural playback method can be implemented, for example, by an apparatus summing stage 52 as shown in FIG. 4B and can be selected by switch 53. Its output level is adjusted by a variable control 54. It is intended for use with recordings made with two closely spaced microphones or a binaural head. The vast majority of recordings do not fall within this category.

Such recordings already contain considerable phase-shifted and/or out-of phase information, and additional outer ear and head shadow signatures in the binaural case, so the cross-feed out-of-phase amplitudes are correspondingly reduced. However, these recordings have substantial signal content common to both channels. This monauralized content must therefore be reduced relative to the mixed-microphone settings. In this case, the filters are fed to a summing stage 52 before mixing with the left and right equalized signals to further attenuate the monaural component within the 200 Hz-1.5 kHz frequency band. For binaural recordings, the low-pass roll-off must completely block all frequencies above 4 kHz in order to avoid interference with images placed behind the head.

Equalization settings are also correspondingly changed for these recordings. Frequencies greater than ~1 kHz are tilted upward to compensate for reduced high-frequency separation during two-speaker playback. Even though outer ear contributions are already present for angularly- and vertically-displaced sound sources in a binaural recording, the speaker-placement correction is still required.

The equalization tilt for frequencies greater than ~1 kHz similarly depends on speaker separation relative to the listener as well as loudspeaker traits. For example, wide-dispersion loudspeaker types need more high-frequency correction because they reduce high-frequency separation at the listener's ears.

Changes in high-frequency equalization and cross-feed levels in turn influence the relative volume setting for frequencies below 200 Hz in order to maintain tonal balance.

Generally, equalization settings above 1 kHz and cross-feed amplitudes both increase with reduced spacing between speakers relative to a listener, reduced separation in recordings, and broad-dispersion loudspeakers.

Figure 6:
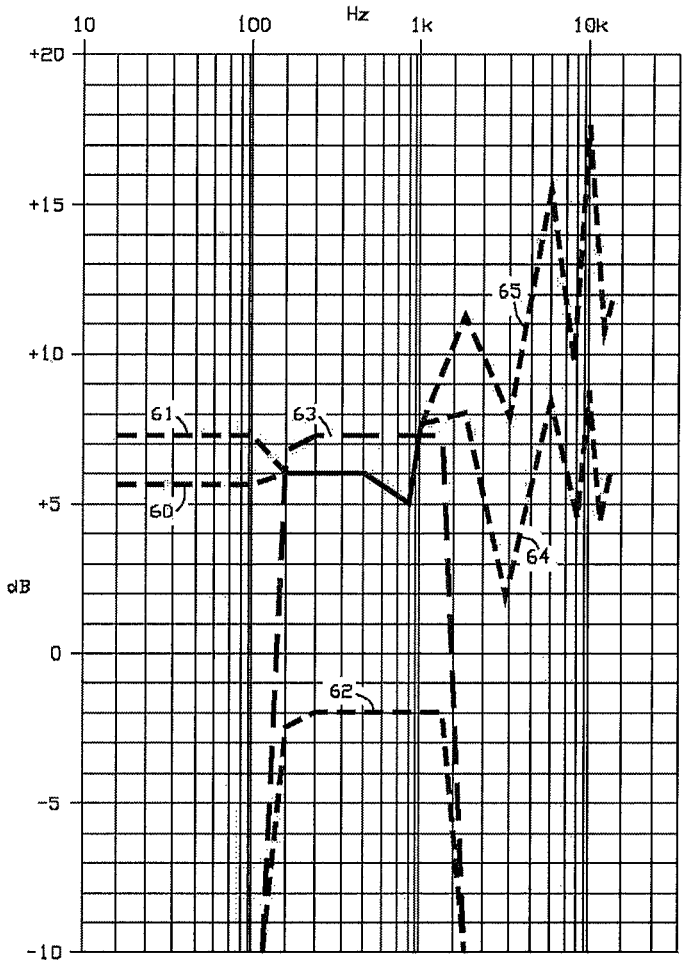
FIG. 6 illustrates graphical plots for ranges of equalization and filter/phase cross-feed settings.

An example of the range of equalization adjustments for use in the process according to the invention in equalization stages 44 and 45 is shown in FIG. 6, but does not necessarily represent the range limits for some actual situations. These modified settings for two-speaker playback differ from the pure azimuth curves for speakers placed to the sides of a listener because the dynamic process recovers the full forward 180° free-field of the listener. A typical range of equalization settings for frequencies below ~200 Hz is shown by segments 60 and 61. A range of filtered and phased cross-feed settings for various speaker geometries and separations in recordings is indicated by plots 62 and 63. A range of typical equalization settings for frequencies above 1 kHz for various speaker types, loudspeaker geometries, and separations in recordings are indicated by plots 64 and 65. The effects of altering the filtered and phased cross-feed amplitudes on the corresponding portion of equalization curves at 200 Hz-1.5 kHz are not shown. The overall gain can be adjusted using the equalization and filter level settings.

The subject invention is not limited to the particular details of construction, components, and processes described herein since many equivalents will suggest themselves to those schooled in the art. It is clear, for instance, that the application of the new STF azimuth parameters can be applied to any two-speaker stereo playback process for more accurate reproduction. Equally, applications of the above frequency and amplitude cues that elicit human localization responses can be applied to any such playback process incorporating these STFs. Further, the equalization process may be implemented using a conventional equalizer or a digital signal processor (DSP). Equalization, or the entire process, can be executed in software. Also, the optional binaural feature can be used as an additional compensation device for the frequency range 200 Hz-1.5 kHz when playback loudspeakers are very closely spaced relative to a listener. It will also be appreciated that portions of the equalization curve can be averaged. For example, the peaks and dips above 4 kHz can be averaged and centered generally around the 10 kHz region without departing from the spirit of this aspect of the invention.

What is claimed is:

1. Apparatus for reproducing three dimensional sound positions from stereo recordings, comprising (a) a mixed bridge receiving a first and second input signals, respectively, from the recording, and accommodating amplitude discrimination and cross-talk with a changing angle relative to a human listener;

(b) first and second equalizers connected with said mixed bridge for producing first and second equalizer signals which correct for anatomically head and outer ear related azimuth discrimination; and (c) first and second bandpass filters for receiving said first and second equalizer signals from said first and second equalizers, respectively, said filters accommodating phase and amplitude discrimination with a changing angle corresponding to channel balance relative to a human listener; whereby when the outputs from said first equalizer and said second filter are combined and the outputs of said second equalizer and said first filter are combined, two output signals are produced which simultaneously accommodate the Fletcher-Munson related localization abilities of a human listener to reproduce the three dimensional sound positions from the recording.

2. Apparatus as defined in claim 1, wherein said first and second bandpass filters are adjustable.

3. Apparatus as defined in claim 2, wherein said first and second bandpass filters are phase-shifted cross-fed bandpass filters.

4. Apparatus as defined in claim 1, wherein said mixed bridge includes a bridge/bypass selector switch and a control for varying the degree of cross-feed provided by the bridge to reduce the amplitude of single channel signals relative to monaural signals and to compensate for excessive separations in mixed multi-microphone recordings.

5. Apparatus as defined in claim 4, wherein said bridge/bypass selector switch is connected with said cross-feed control.

6. Apparatus as defined in claim 1, and further comprising a summing device connected with said first and second bandpass filters.

7. Apparatus as defined in claim 6, wherein said summing device includes a variable control for adjusting an output level of said summing device and a selector switch, whereby binaural playback of recordings made with two closely spaced microphones is accomplished.

8. A method for reproducing three dimensional sound positions from stereo recordings, comprising the steps of (a) mixing first and second input signals from a recording in accordance with channel balance to produce mixed signals which accommodate amplitude discrimination and cross-talk with changing angles relative to the human listener;

(b) equalizing said mixed signals to produce first and second equalized signals which are corrected for anatomical head and outer ear related azimuth discrimination; and (c) filtering said first and second equalized signals via bandpass filters, respectively, to produce first and second filtered signals to accommodate phase and amplitude discrimination with a changing angle corresponding to channel balance relative to a human listener, when said first equalized signal and said second filtered signal are combined and when said second equalized signal and said first filtered signal are combined, the resultant phase, amplitude and equalization of the first and second equalized signals are dynamically altered in real time according to the stereo recordings to simultaneously accommodate the Fletcher-Munson related localization abilities of the human listener.

9. A method as defined in claim 8, and further comprising the step of compensating for loudspeaker location equalization settings.

10. A method as defined in claim 8, wherein said mixing step includes reducing amplitudes of single channel signals relative to monaural signals to provide proper distance perception of centrally-located images.

11. A method as defined in claim 10, wherein said mixing step further comprises adjusting the cross-feed of the first and second input signals to compensate for excessive separations in mixed multi-microphone recordings.

12. A method as defined in claim 11, wherein said equalizing step includes compensating for reduced high-frequency separation during two-speaker playback.

13. A method for deriving stereo transfer curves for a pair of stereo speakers relative to a reference speaker, comprising the steps of (a) selecting a sound frequency;

(b) determining an output level from the references speaker in accordance with the sound frequency from the reference speaker;

(c) determining an output level from the references speaker in accordance with the sound frequency from the pair of stereo speakers;

(d) adjusting the output level from each speaker of the pair of stereo speakers to produce adjusted levels each of which equals the output level from the reference speaker;

(e) comparing the adjusted levels and angular location of the pair of stereo speakers to the location of the reference speaker; and (f) plotting said adjusted levels for each of the stereo speakers for the selected frequency.

14. A method as defined in claim 13, wherein said reference speaker is arranged in front of the listener or at one side of the listener.

15. A method as defined in claim 14, and further comprising repeating steps (b) through (e) until there is no difference in level and angular location.

16. A method as defined in claim 15, and further comprising the steps of selecting another frequency and repeating steps (b) through (f).

17. A method as defined in claim 16, wherein the frequency of one of said pair of stereo speakers is fixed 180° out of phase relative to the frequency of the other of said pair of stereo speakers.

18. A method for generating a stereo transfer function, using a first spaced pair of stereo loudspeakers arranged in front of a listener and a second spaced pair of stereo loudspeakers arranged on opposite sides of the listener, respectively, each of said loudspeakers being arranged equidistant from and at an angle relative to the listener, comprising the steps of (a) establishing a geometric relationship between the listener and the first spaced pair of stereo loudspeakers, each of said loudspeakers having an audio output;

(b) adjusting the audio outputs from said first spaced pair of stereo loudspeakers in said geometric relationship to recreate angular locations of a single sound source relative to the listener; and (c) measuring said adjusted audio outputs, whereby a plot of said measurements represents the stereo transfer function.

19. A method as defined in claim 18, wherein said audio outputs are adjusted at a selected frequency.

20. A method as defined in claim 19, wherein said steps are repeated at different selected frequencies.

* * * * *